US009308555B2

(12) United States Patent
Yaver

(10) Patent No.: US 9,308,555 B2
(45) Date of Patent: Apr. 12, 2016

(54) SCREEN PANEL

(75) Inventor: Imam Syed Yaver, West Bengal (IN)

(73) Assignee: TEGA Industries Limited, Kolkata (IN)

( * ) Notice: Subject to any disclaimer, the term of this patent is extended or adjusted under 35 U.S.C. 154(b) by 0 days.

(21) Appl. No.: 14/001,757

(22) PCT Filed: Feb. 28, 2011

(86) PCT No.: PCT/IN2011/000119

§ 371 (c)(1),
(2), (4) Date: Oct. 9, 2013

(87) PCT Pub. No.: WO2012/117407

PCT Pub. Date: Sep. 7, 2012

(65) Prior Publication Data

US 2014/0021107 A1 Jan. 23, 2014

(51) Int. Cl.

*B07B 1/49* (2006.01)
*B07B 1/46* (2006.01)
*B07B 1/04* (2006.01)

(52) U.S. Cl.

CPC ..... *B07B 1/4609* (2013.01); *B07B 1/04* (2013.01); *B07B 1/469* (2013.01); *B07B 2201/02* (2013.01); *Y10T 29/49* (2015.01)

(58) Field of Classification Search

CPC ..... B07B 1/00; B07B 1/04; B07B 1/46; B07B 1/4609; B07B 1/4645; B07B 2201/02; B07B 1/469

USPC ..... 209/395, 399, 403, 405, 409, 412, 414

See application file for complete search history.

(56) References Cited

U.S. PATENT DOCUMENTS 4,892,767 A * 1/1990 Freissle ..... B07B 1/4645 209/414
5,385,241 A * 1/1995 Bokor ..... B07B 1/469 209/399
5,816,413 A * 10/1998 Boccabella ..... B07B 1/4672 209/399
6,006,923 A * 12/1999 Helmy ..... B07B 1/4645 209/397
6,267,246 B1 * 7/2001 Russell ..... B07B 1/4618 209/399
7,413,087 B2 * 8/2008 Kriel ..... B07B 1/4645 209/399

(Continued)

FOREIGN PATENT DOCUMENTS

DE 3033849 A1 4/1982
DE 8712708 U1 11/1987
WO WO-2011/013135 A2 2/2011

OTHER PUBLICATIONS

International Search Report dated Nov. 8, 2011 issued on corresponding International Patent Application No. PCT/IN2011/000119.

(Continued)

*Primary Examiner* — Prasad Gokhale

(74) *Attorney, Agent, or Firm* — Locke Lord LLP; Joshua L. Jones; Christopher J. Cillié

(57) ABSTRACT

A screen panel for mining and quarrying industries adapted to be mounted on a screen deck includes a screening surface made up of materials such as herein described formed on a reinforcing. The screening surface has apertures of a predetermined shape for allowing materials of predetermined size to pass through the apertures and the reinforcing is an external reinforcing for efficiently screening material passing through the apertures.

15 Claims, 2 Drawing Sheets

(56) References Cited

U.S. PATENT DOCUMENTS

| | | | | |
|---|---|---|---|---|
| 7,621,406 | B2 * | 11/2009 | Freissle | B07B 1/46 209/399 |
| 7,959,009 | B2 * | 6/2011 | Weaver | B07B 1/4645 209/405 |
| 8,469,199 | B2 * | 6/2013 | Gronvall | B07B 1/4645 209/399 |
| 8,950,585 | B2 * | 2/2015 | Biswadeep | B07B 1/4645 209/392 |
| 8,960,445 | B2 * | 2/2015 | Malmberg | B07B 1/00 209/235 |
| 2002/0046964 | A1 * | 4/2002 | Russell | B07B 1/4618 209/399 |
| 2002/0056667 | A1 * | 5/2002 | Baltzer | B01D 33/0376 209/405 |
| 2003/0034279 | A1 | 2/2003 | Baltzer et al. | |
| 2003/0038060 | A1 * | 2/2003 | Freissle | B07B 1/46 209/405 |
| 2005/0189265 | A1 * | 9/2005 | Malmberg | B07B 1/4645 209/363 |
| 2009/0050539 | A1 * | 2/2009 | Gronvall | B07B 1/4645 209/391 |
| 2009/0184032 | A1 * | 7/2009 | Zubovich | B07B 1/46 209/405 |
| 2009/0301944 | A1 * | 12/2009 | Kriel | B07B 1/4645 209/405 |
| 2010/0006481 | A1 * | 1/2010 | Waites, Jr. | B07B 1/4645 209/405 |
| 2012/0199521 | A1 * | 8/2012 | Mohanka | B07B 1/4609 209/392 |
| 2013/0026080 | A1 * | 1/2013 | Mohanka | B07B 1/4609 209/392 |
| 2014/0124417 | A1 * | 5/2014 | Holton | B07B 1/46 209/412 |

OTHER PUBLICATIONS

Examination issued by the European Patent Convention on Sep. 26, 2014 for Application No. 11722174.

* cited by examiner

SCREEN PANEL

CROSS-REFERENCE TO RELATED APPLICATIONS

This application is a U.S. national stage application under 35 U.S.C. 371 of International Application No. PCT/IN2011/000119, filed Feb. 28, 2011, the contents of which is incorporated herein by reference in its entirety.

FIELD OF THE INVENTION

The present invention in general relates to an improved screen panel and in particular, to screen panels, which have external reinforcement and possess high open area and low thickness, said screen panels being applied for screening/separating or grading of minerals in the mining and quarrying industries. The present invention also relates to a method of manufacturing such improved screen panels.

BACKGROUND OF THE INVENTION

Screening panel system for ore screening decks that is now widely used by the mining industry, replaced the earlier screening cloths and large wire screening frames. These screening panels are known to be either of Rubber or Polyurethane with steel reinforcements. It is also known that such panels are manufactured by hot vulcanized method or casting. The panels are adapted to be secured with the support frame of the screen machine by bolting. The panels may also be secured to the frame with an alternate method using a pin and separate lug arrangement.

The screen panels known in the art, as described aforesaid, suffer from the vital disadvantage of degradation of screening efficiency, due to low open area compared to the conventional screen desks. Of course, clogging of screen panels and absence of substantial flexibility are the other deficiencies, which are frequently encountered in the field. Research is on in this area for a considerably long period of time to substantially increase the screening efficiency, simultaneously ensuring prevention of clogging and substantial flexibility for continuous screening. However, significant breakthrough in that perspective is yet to be achieved.

Accordingly there was a long felt need to design screen panels for its application in mining and quarrying industries, which have substantially increased screening efficiency and which simultaneously ensure prevention of clogging and substantial flexibility for continuous screening.

The present invention meets the aforesaid long felt need.

All through out the specification including the claims, the words "screen panel", "screen deck" "mining", "quarrying", "mineral", "ores", " reinforcement", "support", "walls", "button", "sleeve", "screening device", "screening deck", are to be interpreted in the broadest sense of the respective terms and includes all similar items in the field known by other terms, as may be clear to persons skilled in the art. Restriction/limitation, if any, referred to in the specification, is solely by way of example and understanding the present invention.

OBJECTS OF THE INVENTION

It is the principal object of the present invention to provide a screen panel for its application in mining and quarrying industries, which has substantially increased screening efficiency.

It is yet another object of the present invention to provide a screen panel for its application in mining and quarrying industries which has substantially increased screening efficiency by virtue of external reinforcement.

It is a further object of the present invention to provide a screen panel for its application in mining and quarrying industries, having increased number of apertures by virtue of external reinforcement, whereby high open area and low thickness are ensured.

It is a further object of the present invention to provide a screen panel for its application in mining and quarrying industries which ensures prevention of clogging by virtue of flaring design of hole shape and also ensures substantial flexibility for continuous screening.

It is another object of the present invention to provide a screen panel for its application in mining and quarrying industries, which is available at a fairly reasonable price by virtue of its reasonably low manufacturing cost.

It is another object of the present invention to provide a method for manufacturing a a screen panel for its application in mining and quarrying industries, which has substantially increased screening efficiency by virtue of external reinforcement.

It is a further object of the present invention to provide a screening deck for its application in the mining and quarrying industry, having mounted thereon a screen panel which has substantially increased screening efficiency by virtue of external reinforcement.

It is a further object of the present invention to provide a screening deck for its application in the mining and quarrying industry, having mounted thereon a plurality of screen panels, for its application in mining and quarrying industries, each said screen panel having substantially increased screening efficiency by virtue of external reinforcement.

How the foregoing objects are achieved and the other aspects of the present invention, will be clear from the following description which is purely by way of understanding and not by way of any sort of limitation.

SUMMARY OF THE INVENTION

Accordingly, the present invention provides a screen panel for mining and quarrying industries adapted to be mounted on a screen deck, including a screening surface made up of materials such as herein described formed on a reinforcing, said screening surface having suitably designed apertures of desired shape for allowing materials of desired size to pass through, said, said reinforcing being an external reinforcing, whereby screening efficiency of said screen panel is substantially enhanced.

In accordance with preferred embodiments of the screen panel of the present invention:

- said reinforcing is a steel reinforcing and is adapted to be mechanically fixed to said panel by button type fixing.
- said reinforcing comprises externally reinforced body/support with panel fixing frame under the edge surface of said panel.
- said screen panel has a substantially high number of apertures thereby increasing the open area of said panel substantially and also reducing the thickness of said panel substantially.
- said apertures have a flaring design of hole shape thereby preventing clogging substantially and edges of said panel and gaps between said apertures are substantially reduced.
- said screening surface, other than said apertures, are made of any one of or a combination of mild steel, stainless steel, rubber and/or polyurethane with or without steel reinforcing.

said panel comprises of vulcanized material, rubber polyurethane, having external steel reinforcing bars under the edge surface of said panel.

The present invention also provides a method of manufacturing a screen panel for mining and quarrying industries adapted to be mounted on a screen deck, including designing a screening surface made up of materials such as herein described formed on a reinforcing, said method further including making suitably designed apertures of desired shape on said screening surface, for allowing materials of desired size to pass through wherein said reinforcing is formed as an external reinforcing in the manner such as herein described, whereby screening efficiency of said screen panel is substantially enhanced.

In accordance with preferred embodiments of the method of the present invention:

said reinforcing is a steel reinforcing and is mechanically fixed to said panel by button type fixing under the edge surface of said panel.

The present invention also provides a screening deck for mining and quarrying industries, having mounted thereon a plurality of screen panels, each said panel including screening surface made up of materials such as herein described formed on a reinforcing, said screening surface having suitably designed apertures of desired shape for allowing materials of desired size to pass through, said reinforcing being an external reinforcing whereby screening efficiency of said screen panel is substantially enhanced.

BRIEF DESCRIPTION OF THE ACCOMPANYING DRAWINGS

The nature and scope of the present invention, will be better understood from the accompanying drawings, which are by way of illustration of some preferred embodiments and not by way of any sort of limitation. In the accompanying drawings, FIG. 1 illustrates a plan view of the screening surface incorporating the screen panel in accordance with a preferred embodiment of the present invention.

DETAILED DESCRIPTION OF THE INVENTION

The following describes some preferred embodiments of the present invention, which are purely for the sake of understanding the performance of the invention, and not by way of any sort of limitation.

The screen panels are mounted on screen decks for causing screening/separating or grading of minerals in the mining and quarrying industries. The present invention is aimed at providing screen panels for its application in mining and quarrying industries, which have external reinforcement/support with the panel fixing frame under the edge surface (7) of the panel. This ensures substantial increase of screening efficiency of the panel. That apart, this facilitates increasing the number of apertures (8), whereby high open is ensured. Simultaneously, this also ensures reduction in thickness. Furthermore, due to the high open area and low thickness the weight of polyurethane required to be applied for manufacturing the screen panel is less. Since there is reduction in polyurethane weight, so the cost of production goes down, which ensures its availability at a fairly reasonably low price. The screen panels in accordance with the present invention, nullifies/substantially reduces the drawbacks of the screen panels known in the art, as discussed hereinbefore under the heading "Background of the Invention".

Figure 1:
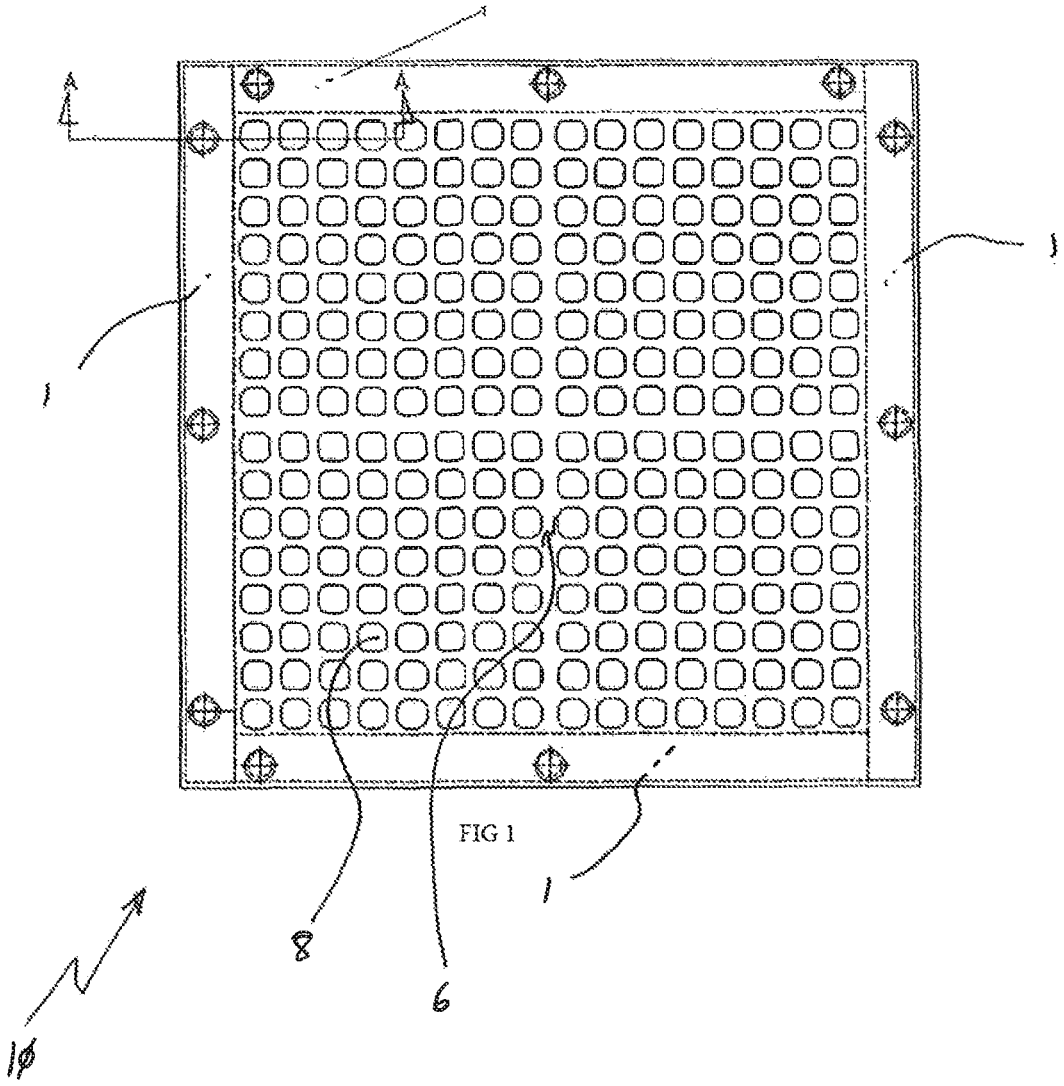

The accompanying FIG. 1, illustrates a preferred embodiment of the screen panel according to the present invention. It shows the panel fixing frame (1) that is bolted/welded to the frame under the screen deck (10). Conventionally, reinforcements such as steel reinforcements are provided inside the panel. In accordance with the present invention, the reinforcement is kept externally. This increases the screening efficiency. Conventionally, the reinforcements such as but not limited to screen reinforcements, in all screen panels, are bonded to the polyurethane or rubber part chemically. As a preferred embodiment in accordance with the present invention, the reinforcement (2) is mechanically fixed to the panel by button type fixing (3).

Figure 2:
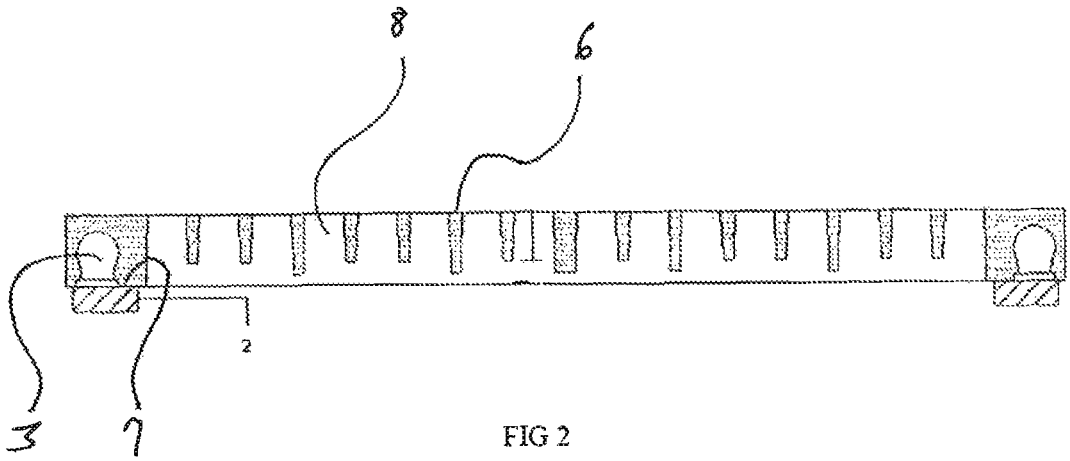
FIG. 2 illustrates a sectional side view of the screening surface illustrated in FIG. 1 along the line A-A.

The accompanying FIG. 2 illustrates a sectional view of the screen panel in accordance with the present invention, along the line A-A in the accompanying FIG. 1. It also illustrates the external reinforcement (2) which constitutes the crux of the present invention. The accompanying FIG. 3 illustrates a pictorial view of a preferred embodiment of the screening area polyurethane screen panel of the present invention.

Figure 3:
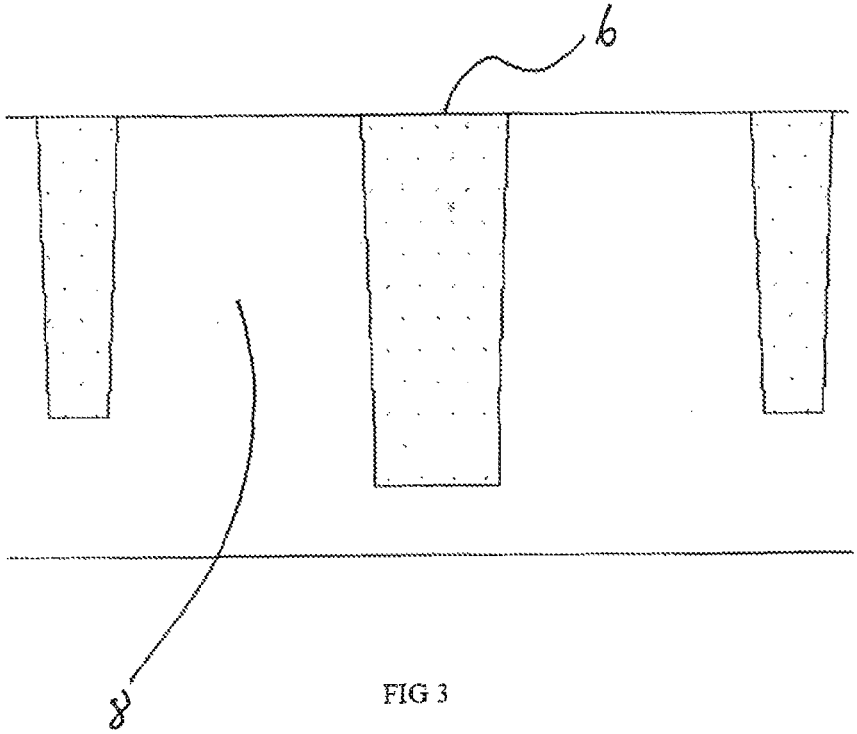
FIG. 3 illustrates a pictorial view of the screening area of polyurethane screen panels according to a preferred embodiment of the present invention.

As illustrated in the accompanying FIGS. 2 and 3, the edges of the screen panels according to the present invention have been reduced, the gaps between the apertures have been reduced and the central bar wide portion of internal reinforcements as given in conventional types are also reduced. These increase the open area by virtue of the increase in the number of apertures. The thickness of the panels is also as a consequence, substantially reduced. This in turn ensures reduction in mass of polyurethane that is applied to manufacture the screen panels which in turn reduces the manufacturing cost and the cost at which such screen panels are made available to its users. Reduction in cost is also facilitated by clubbing the fixing system and the reinforcement. The apertures are suitably designed to desired shape, for allowing materials of desired size to pass through. The apertures are made of suitable abrasion resistant material as will be known to persons skilled in the art.

The screening device in accordance with the present invention improves the screening efficiency as well as prevents clogging due to the flaring design of the hole shape. Substantial flexibility is also ensured to have continuous screening without clogging due to the absence of internal reinforcement. Thus, not only is the screening efficiency improved to a great extent but also, it provides adequate flexibility. The polyurethane helps to take the impact of the materials coming in contact with the screening surface, whereas the apertures prevent clogging due to the flaring type design.

The screen panel in accordance with the present invention is manufactured by hot vulcanizing or casting with rubber or polyurethane having external reinforcement/support with the panel fixing frame under the edge surface of the panel. In this arrangement, the number of apertures are increased to a great extent i.e. open area increased to the highest level compared to any other panel, for which efficiency of the screen deck is enhanced substantially. The screen panels, not being internally reinforced and being less thick weighs less and thus provide adequate flexibility. This helps to have continuous screening which further results in maximum output for the user.

The present invention is applicable for all desired shapes of apertures, as required in the industry. The panels may be of different sizes, i.e.—modular type (305×305 mm and 610×300 mm) and larger sizes also. For modular type snap on type fixing, like button type, pin and sleeve type may be provided for mounting on to the screen deck.

Preferably, the screening surface (6), other than said apertures, are made of any one of or a combination of mild steel, stainless steel, rubber and/or polyurethane with or without steel reinforcing. Preferably, the screen panel comprises of vulcanized material, rubber polyurethane, having external steel reinforcing bars under the edge surface of panel.

The method of manufacturing a screen panel for mining and quarrying industries adapted to be mounted on a screen deck, according to the present invention includes designing a screening surface made up of materials such as herein described formed on a reinforcing. The method further includes making suitably designed apertures of desired shape on said screening surface, for allowing materials of desired size to pass through. As a prerequisite, the reinforcing is formed as an external reinforcing as described before, whereby screening efficiency of the screen panel is substantially enhanced. Preferably, the reinforcing is a steel reinforcing and is mechanically fixed to the panel by button type fixing, under the edge surface of the panel. The reinforcing may be a reinforced steel bar.

The present invention has been described with reference to some drawings and preferred embodiments, purely for the sake of understanding and not by way of any limitation and the present invention includes all legitimate developments within the scope of what has been described hereinbefore and claimed in the appended claims.

I claim:

1. A screen panel for mining and quarrying industries adapted to be mounted on a screen deck, comprising:

a screening surface formed on a reinforcing, said screening surface having apertures with a flared shape for allowing materials of predetermined size to pass through said apertures, wherein said reinforcing is disposed externally and underlays a lower surface of said screen panel, wherein said reinforcing includes a plurality of button type projections coupled to said reinforcing, wherein said plurality of button type projections seat within sockets defined within an interior of said screen panel arranged about a periphery of said screen panel, said socket extending from an opening defined within said lower surface of said screen panel, wherein all edges of said periphery include said sockets, wherein said reinforcing includes a separate button type projection for each respective socket of said screen panel.

2. The screen panel as recited in claim 1, wherein said reinforcing is a steel reinforcing.

3. The screen panel as recited in claim 1, wherein said reinforcing comprises a panel fixing frame disposed under an edge surface of said screen panel.

4. The screen panel as recited in claim 1, wherein a bounding portion of said screening surface separating adjacent apertures has a width that is less than a width of said adjacent apertures.

5. The screen panel as recited in claim 1, wherein said apertures flare between a first width at said screening surface and second width at said lower surface, said first width being smaller than said second width.

6. The screen panel as recited in claim 1, wherein said screening surface includes any one of or a combination of mild steel, stainless steel, rubber and polyurethane with or without steel reinforcing.

7. The screen panel as claimed in claim 1, wherein said panel comprises at least one of a vulcanized material, rubber, or a polyurethane material.

8. A screening deck for mining and quarrying industries, having mounted thereon at least one screen panel as recited in claim 1.

9. The screen panel as recited in claim 1, wherein said reinforcing is disposed under each edge of said screen panel.

10. The screen panel as recited in claim 1, wherein said reinforcing extends continuously under and about edges of said screen panel.

11. The screen panel as recited in claim 1, wherein said reinforcing is disposed under a lower surface of said screen panel and adjacent to edges of said screen panel.

12. The screen panel as recited in claim 11, wherein said reinforcing support said screen panel along each of four edges of said screen panel.

13. A method of manufacturing a screen panel for mining and quarrying industries adapted to be mounted on a screen deck, said method comprising:

forming a screen panel with a screening surface and an opposed bottom surface, defining apertures of predetermined shape for allowing materials of predetermined size to pass through said apertures; and defining sockets within an interior of said screen panel extending from an opening in said lower surface of said screen panel along all edges of said screen panel, wherein each of said sockets is configured and adapted for seating a button type projection extending from a reinforcing underlying said lower surface of said screen panel.

14. The method as claimed in claim 13, further including mechanically fixing a reinforcing to said lower surface of said screen panel by inserting a button type fixing into said socket.

15. A screen panel for mining and quarrying industries adapted to be mounted on a screen deck, comprising:

a screening surface formed on a reinforcing, said screening surface having apertures with a flared shape for allowing materials of predetermined size to pass through said apertures, wherein said reinforcing is a steel reinforcing disposed externally of said screening surface and underlays a lower surface of said screen panel, wherein said reinforcing includes a plurality of button type projections coupled to said reinforcing, wherein said plurality of button type projections seat within sockets defined within an interior of said screen panel arranged about a periphery of said screen panel, said socket extending from an opening defined within said lower surface of said screen panel, wherein all edges of said periphery include said sockets, wherein said reinforcing includes a separate button type projection for each respective socket of said screen panel, wherein each of said plurality of button type projections three or more button type projections having a knob-like shape, and wherein each said button type projection spans only a portion of a length of said reinforcing.

* * * * *